United States Patent [19]

Tsuyama

[11] Patent Number: 4,583,153

[45] Date of Patent: Apr. 15, 1986

[54] LAMP

[75] Inventor: Sadaharu Tsuyama, Osaka, Japan

[73] Assignee: Tsuyama Mfg. Co., Ltd., Japan

[21] Appl. No.: 662,016

[22] Filed: Oct. 18, 1984

[30] Foreign Application Priority Data

Jan. 24, 1984 [JP] Japan ..... 59-9067[U]

[51] Int. Cl.[4] ..... F21V 7/02

[52] U.S. Cl. ..... 362/72; 362/299; 362/300; 362/346

[58] Field of Search ..... 362/72, 208, 297, 298, 362/299, 300, 304, 346, 307, 347, 350

[56] References Cited

U.S. PATENT DOCUMENTS 3,283,142 11/1966 Freeman ..... 362/298

3,443,086 5/1969 Rikis ..... 362/346

*Primary Examiner*—William A. Cuchlinski, Jr.

*Attorney, Agent, or Firm*—Allegretti, Newitt, Witcoff & McAndrews, Ltd.

[57] ABSTRACT

A lamp comprising a concave mirror; a light source located at the focus of said concave mirror; a lens means provided in front of said concave mirror and said light source comprising a central portion for allowing light from said light source to pass directly outward therethrough, and a peripheral portion around said central portion for providing directivity with the light reflected from said concave mirror by allowing the light to pass outward therethrough. The improvement comprises an annular reflector provided on the peripheral portion of the central part inside said lens means for reflecting light emitted from said light source toward said peripheral portion of said lens means back towards said concave mirror past said light source. Light reaching the concave mirror from the annular reflector and light reaching the concave mirror directly from the light source are directed toward the lens in directions parallel to the axis of the light source, thereby providing enhanced illumination by the lamp.

3 Claims, 4 Drawing Figures

LAMP

FIELD OF THE INVENTION

The present invention relates to an improvement in the structure of a lamp or an illuminating device for use with, for example, a bicycle.

BACKGROUND OF THE INVENTION

The present invention relates to a lamp and more particularly to a lamp wherein substantially all light emitted from a light source is directed in a desired direction.

A conventional lamp for a bicycle or like vehicle includes a light source, a concave mirror, and a lens. The lens comprises a central portion and a peripheral portion which portions have different directivity to light. That is, the central portion directs or deflects light from the light source, while the peripheral portion directs or deflects light which is emitted from the light source and reflected by the concave mirror. Thus, of the light emitted from the light source, the light reaching the peripheral portion of the lens goes through the lens without undergoing directivity by the lens so that such light hardly contributes to the illumination by the lamp.

SUMMARY OF THE INVENTION

An object of the present invention is to provide an improved lens which overcomes deficiencies and disadvantages of prior contructions.

Another object of the present invention is to provide a lamp so constructed as to provide highly effective use of the light emitted from the light source for the purpose of illumination. Other objects and advantages of the present invention will be made more apparent hereinafter.

In order to achieve the objects, the lamp according to the present invention is provided with an annular reflector mounted adjacent to the lens. That is, the lamp according to the present invention comprises a concave mirror; a light source located at the focus of said concave mirror; and a lens means provided in front of said concave mirror and said light source. The lens means comprises a central portion for allowing light from said light source to pass directly outward therethrough, and a peripheral portion around said central portion for providing directivity for the light reflected from said concave mirror by allowing the light to pass outward therethrough. The improvement comprises an annular reflector provided on the peripheral portion of the central portion inside said lens means for reflecting light emitted from said light source towards said peripheral portion of said lens means back toward said concave mirror and through said light source. Light reaching the concave mirror from the annular reflector and light reaching the concave mirror directly from the light source travel in horizontal directions toward the lens, thereby providing enhanced illumination from the light.

BRIEF DESCRIPTION OF THE DRAWINGS

The present invention will now be described, by way of example only, with reference to the accompanying drawing, in which.

DESCRIPTION OF THE PREFERRED EMBODIMENT

Figure 1:
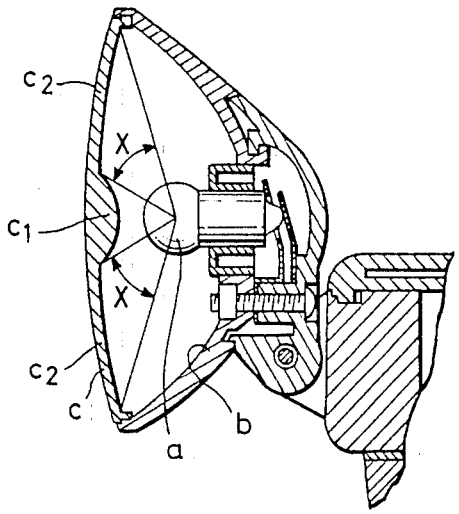
PRIOR ART FIG. 1
FIG. 1 is a longitudinal sectional view of a conventional lamp.

FIG. 1 of the drawing shows a conventional lamp including a light source a, a concave mirror b and a lens c. The lens c comprises a central portion c1 and a peripheral portion c2, which have different directivity to light. That is, the central portion c1 directs or deflects light from the light source a, while the peripheral portion c2 directs or deflects light which is emitted from the light source a and reflected by the concave mirror b. Thus, part of the light emitted from the light source a reaches the peripheral portion c2 of the lens c as denoted by the lens surface within the lines defining the angle indicated by X in FIG. 1 and goes through the lens c without undergoing directivity by the lens. Such misdirected light hardly contributes to the illumination by the lamp.

Figure 2:
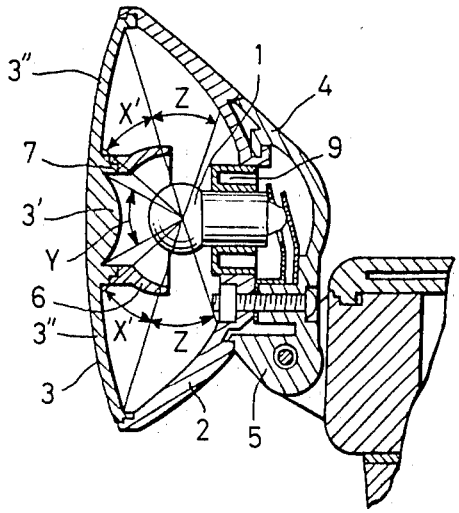
FIG. 2 is a longitudinal sectional view of an embodiment of the lamp according to the invention.
Figure 3A:
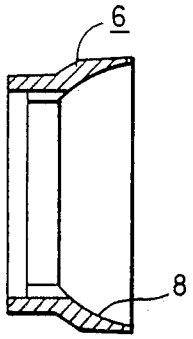
FIG. 3A is an enlarged longitudinal sectional view of a reflector used in the lamp according to the invention.
Figure 3B:
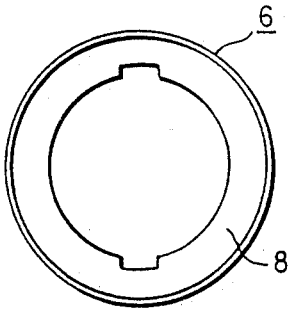
FIG. 3B is a plan view of the reflector of FIG. 3A.

In FIG. 2 which shows the entire construction of an embodiment of the lamp of the invention, reference numerals 1, 2, and 3 respectively denote a light source, a concave mirror, and a lens. The light source 1 is located in the center which is the focus of the concave mirror 2. The lens 3 is located in front of the light source 1 and the concave mirror 2, and the lens and the mirror are engaged with each other along their peripheral edges as shown in FIG. 2. 4 is a rear cover, which has a mounting portion 5 to be connected to a battery case. This embodiment of the lamp is to be used with the battery case for a bicycle.

The lens 3, like in the conventional lamp, comprises a central portion 3' and a peripheral portion 3''. On the inside of the lens 3, there is mounted an annular reflector 6 around the central portion 3'. The reflector 6 is fitted on an annular mounting portion 7 which is formed along the periphery of the central portion 3' and is integral with the lens. The reflector 6 is made of a synthetic resin, and on its reflecting surface 8, there is deposited an aluminium layer by vacuum evaporation or sputtering. The reflecting surface 8 is of the shape of a curved concave mirror, and is provided so as to partially encircle the light source 1 in such a manner that it interrupts light from the light source 1 to the peripheral portion 3'' of the lens 3, such light being denoted within the angle X' in FIG. 2. The reflecting surface 8 reflects such light within the angle X' toward the said concave mirror 2 through the light source 1. The light reaching the concave mirror 2 from the reflector 6, together with the light directly reaching the mirror 2 from the light source, travels in horizontal directions toward the lens 3. That is, the light within the angle X', passing outward through the lens 3 without being directed by the lens in the desired direction in the prior art, radiates from the lamp in the desired direction assisted by the function of reflector 6, thereby contributing to improvement in illumination. Therefore, the light within the angle Y from the light source 1 passes through the central portion 3' of the lens 3 which directs it in the desired direction (substantially axially of the light source), while the light within the angles X' and Z, respectfully, is reflected by the concave mirror 2 to reach the lens 3 thereby directed; all the light emitted from the light source 1, except light reaching the mount 9 for the light source 1, is effectively directed (generally in parallel directions to the axis of the light source) and contributes to the improved illumination.

It should be noted that the lamp according to the invention may also be incorporated in a device such as a flashlight.

As understood from the foregoing, the present invention provides a useful illuminating device which makes good use of the light from the light source and provides a brighter illumination (30% higher in luminous intensity) than the comparable prior art device.

While there has been shown and described a presently preferred form of the present invention, it will be understood that various changes may be made to the invention without departing from the spirit and scope thereof, and therefore the invention is to be limited only by the following claims.

What is claimed is:

1. For use with a lamp comprising a concave mirror; a light source located at the focus of said concave mirror; and lens means provided in front of said concave mirror and said light source comprising a central portion for allowing light from said light source to pass directly outward therethrough, and a peripheral portion around said central portion for providing directivity with the light reflected from said concave mirror by allowing the light to pass outward therethrough; the improvement comprising an annular reflector provided on the peripheral portion of the central portion inside said lens means at least partially encircling the light source for reflecting light emitted from said light source toward said peripheral portion of said lens means back toward said concave mirror past said light source.

2. A lamp as in claim 1 wherein the annular reflector includes a mirror surface facing the light source which is formed in the shape of a concave curve.

3. A lamp as in claim 1 wherein light reflected from the concave mirror and light emitted directly from the light source pass through the lens means in substantially parallel directions, so as to maximize illumination from the lamp.

* * * * *